US011708626B2

(12) United States Patent
Sun et al.

(10) Patent No.: US 11,708,626 B2
(45) Date of Patent: Jul. 25, 2023

(54) TITANIUM-ALUMINUM INTERMETALLIC AND MANUFACTURING METHOD THEREOF FOR IMPROVING CASTING FLUIDITY

(71) Applicant: METAL INDUSTRIES RESEARCH & DEVELOPMENT CENTRE, Kaohsiung (TW)

(72) Inventors: Hong-Yuan Sun, Kaohsiung (TW); Chen Hsueh Chiang, Kaohsiung (TW)

(73) Assignee: METAL INDUSTRIES RESEARCH & DEVELOPMENT CENTRE, Kaohsiung (TW)

( * ) Notice: Subject to any disclaimer, the term of this patent is extended or adjusted under 35 U.S.C. 154(b) by 153 days.

(21) Appl. No.: 17/110,363

(22) Filed: Dec. 3, 2020

(65) Prior Publication Data

US 2022/0178006 A1 Jun. 9, 2022

(51) Int. Cl.
*C22C 14/00* (2006.01)
*C22C 1/02* (2006.01)

(52) U.S. Cl.
CPC ..... *C22C 14/00* (2013.01); *C22C 1/02* (2013.01)

(58) Field of Classification Search
CPC ..... C22C 14/00; C22C 1/02
USPC ..... 420/417
See application file for complete search history.

(56) References Cited

U.S. PATENT DOCUMENTS 5,429,796 A * 7/1995 Larsen, Jr. ..... C22C 32/0073 420/421
2010/0000706 A1* 1/2010 Renkel ..... B22D 21/005 164/114
2020/0207016 A1* 7/2020 Anegawa ..... B33Y 50/02

FOREIGN PATENT DOCUMENTS

CN 107034384 A * 8/2017 ..... C22C 14/00

OTHER PUBLICATIONS

NPL: on-line translation of CN 107034384 A, Aug. 2017. (Year: 2017).*

* cited by examiner

*Primary Examiner* — Jie Yang
(74) *Attorney, Agent, or Firm* — WPAT, P.C

(57) ABSTRACT

A titanium-aluminum intermetallic for improving casting fluidity includes the following elements in atomic percentage: Al: 40 at % to 50 at %, Cr: 1 at % to 8 at %, Nb: 1 at % to 8 at %, Mo: 1 at % to 5 at %, Mn: 1 at % to 6 at %, Ni+Si+Fe: 1 at % to 15 at %, B: 0.05 at % to 0.8 at %, and the balance of Ti and inevitable impurities. The titanium-aluminum intermetallic in the present disclosure has more adequate casting fluidity, that is, has better castability.

7 Claims, 4 Drawing Sheets

30

TITANIUM-ALUMINUM INTERMETALLIC AND MANUFACTURING METHOD THEREOF FOR IMPROVING CASTING FLUIDITY

BACKGROUND

Technical Field

The present disclosure relates to a titanium-aluminum intermetallic and a manufacturing method thereof, and in particular, to a titanium-aluminum intermetallic and a manufacturing method thereof for improving casting fluidity.

Related Art

Global automobile production keeps increasing. For the requirements of reducing fuel consumption and improving urban air quality, there is an increasing demand for engines with low energy consumption and high performance. A turbocharger can significantly increase engine power, improve emissions, and reduce fuel consumption. Therefore, it is a basic trend in modern automobile industry to use small engines with turbochargers to replace naturally aspirated engines. Because turbine blades are subjected to high-temperature and high-pressure exhaust gas from engines, the highest temperature of exhaust gas emitted by diesel engines of passenger vehicles is about 850° C., and the temperature of exhaust gas emitted by gasoline engines may reach 1050° C. Impellers and turbines of turbochargers are not large in size, and generally have diameters not greater than 100 mm. However, a rotation speed is very high and is up to 250,000 r/min. For continuous high-speed operation in severe operating environments, there are very high requirements for materials and performance. Therefore, it is very necessary to develop a material for rotors and blades of high-performance automobile engines.

Compared with other intermetallic compounds, a titanium-aluminum (TiAl) intermetallic has adequate comprehensive performance and has properties such as low density, a high melting point, high oxidation resistance, and excellent high-temperature strength and rigidity. Moreover, the elastic modulus of the TiAl intermetallic is much higher than that of other structural materials, and the TiAl intermetallic used as a structural workpiece can significantly improve tolerance to high-frequency vibration. Compared with a nickel (Ni)-based alloy, the TiAl intermetallic further has better high-temperature creep resistance and good flame-retardant performance.

However, most of turbine blades and turbine rotors such as aerospace engine blades, marine generator blades or automotive turbine rotors used in power devices are thin parts with complex structures. If the TiAl intermetallic is used as a material of the foregoing thin components, products of the thin components can be generally manufactured only by using a lamination manufacturing technology or a post-processing technology, leading to disadvantages such as high manufacturing costs, great material loss, and high processing difficulty. Although attempts have been made to use a casting technology to overcome the foregoing disadvantages and obtain complete product morphology directly, at present, it is still not easy to cast the TiAl intermetallic due to its poor material fluidity, and final casting products still have undesirable properties.

Therefore, there is a need to provide a titanium-aluminum intermetallic and a manufacturing method thereof to resolve the foregoing problems.

SUMMARY

An objective of the present disclosure is to provide a titanium-aluminum intermetallic and a manufacturing method thereof, having more adequate casting fluidity.

In order to achieve the foregoing objective, the present disclosure provides a titanium-aluminum intermetallic for improving casting fluidity, comprising the following elements in atomic percentage: Al: 40 at % to 50 at %, Cr: 1 at % to 8 at %, Nb: 1 at % to 8 at %, Mo: 1 at % to 5 at %, Mn: 1 at % to 6 at %, Ni+Si+Fe: 1 at % to 15 at %, B: 0.05 at % to 0.8 at %, and the balance of Ti and inevitable impurities.

The present disclosure further provides a method of manufacturing a titanium-aluminum intermetallic for improving casting fluidity comprising the following steps of: a smelting step: placing a plurality of smelting raw materials of the titanium-aluminum intermetallic in an induction smelting device, and melting the smelting raw materials to a molten titanium-aluminum intermetallic having casting fluidity; and a casting and curing step: casting the molten titanium-aluminum intermetallic to cure to a titanium-aluminum intermetallic, wherein the titanium-aluminum intermetallic comprises the following elements in atomic percentage: Al: 40 at % to 50 at %, Cr: 1 at % to 8 at %, Nb: 1 at % to 8 at %, Mo: 1 at % to 5 at %, Mn: 1 at % to 6 at %, Ni+Si+Fe: 1 at % to 15 at %, B: 0.05 at % to 0.8 at %, and the balance of Ti and inevitable impurities.

The titanium-aluminum intermetallic in the present disclosure has more adequate casting fluidity, that is, has better castability.

DETAILED DESCRIPTION

To make the foregoing objectives, features, and characteristics of the present disclosure more comprehensible, related embodiments of the present disclosure are described in detail below with reference to the accompanying drawings.

Figure 1:
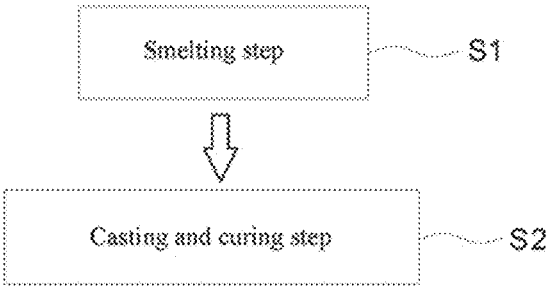
FIG. 1 is a flowchart of a method of manufacturing a titanium-aluminum intermetallic for improving casting fluidity according to an embodiment of the present disclosure.

FIG. 1 is a flowchart of a method of manufacturing a titanium-aluminum intermetallic for improving casting fluidity according to an embodiment of the present disclosure. The method of manufacturing a titanium-aluminum intermetallic in the present disclosure mainly includes the following steps: (1) smelting step S1: placing a plurality of smelting raw materials of the titanium-aluminum intermetallic in an induction smelting device, and melting the smelting raw materials to a molten titanium-aluminum intermetallic having good casting fluidity; and (2) casting and curing step S2: casting the molten titanium-aluminum intermetallic to cure to a titanium-aluminum intermetallic.

Figure 2:
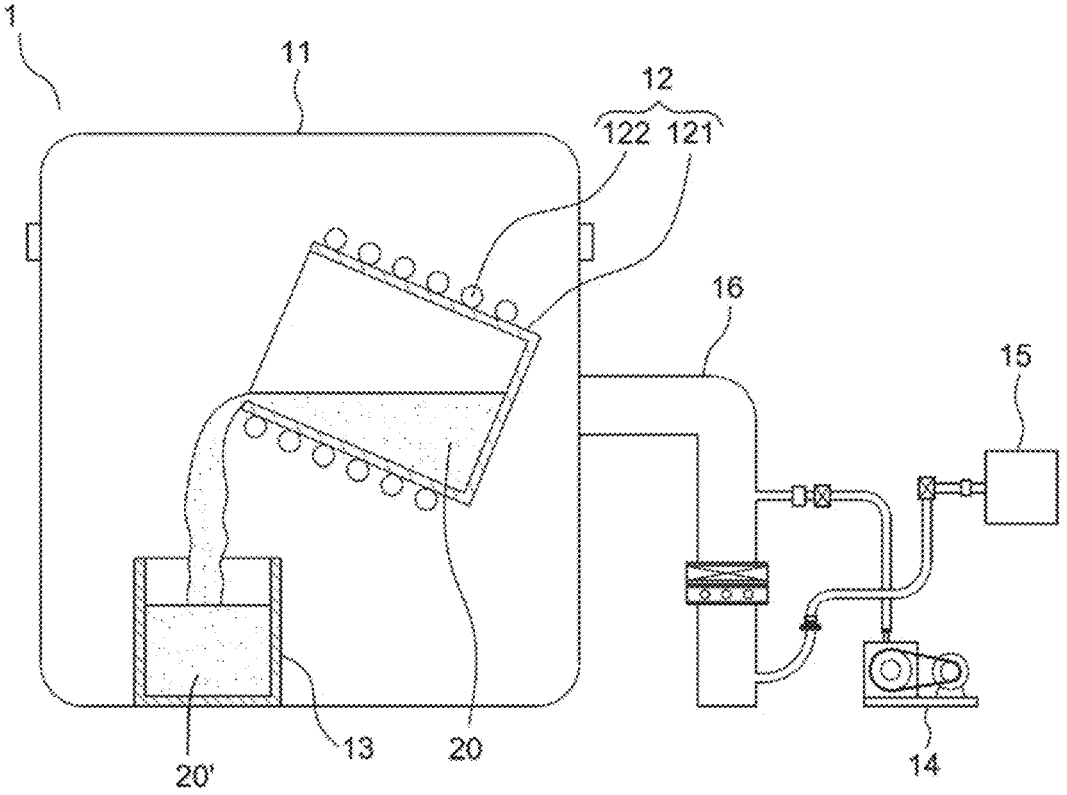
FIG. 2 is a schematic cross-sectional view of a manufacturing device of a titanium-aluminum intermetallic according to an embodiment of the present disclosure.

FIG. 2 is a schematic cross-sectional view of a manufacturing device of a titanium-aluminum intermetallic according to an embodiment of the present disclosure. The manufacturing device 1 of a titanium-aluminum intermetallic includes a closed chamber 11, an induction smelting apparatus 12, a water-cooled mold 13, a vacuum apparatus 14, and a protective gas supply source 15. The induction smelting apparatus 12 is disposed in the closed chamber 11. The induction smelting apparatus 12 includes a water-cooled crucible unit 121 and an induction coil unit 122. The water-cooled crucible unit 121 is configured to accommodate a plurality of smelting raw materials. The induction coil unit 122 surrounds the water-cooled crucible unit 121 and is configured to heat the smelting raw materials by induction to form the molten titanium-aluminum intermetallic 20. The water-cooled mold 13 is disposed in the closed chamber 11 and is configured to accommodate the molten titanium-aluminum intermetallic 20 after casting. The vacuum apparatus 14 is in communication with the closed chamber 11 through a pipeline unit 16 and is configured to vacuumize the closed chamber 11. The vacuum apparatus 14 can be a vacuum pump. The protective gas supply source 15 is in communication with the closed chamber 11 through the pipeline unit 16 and is configured to supply protective gas to the closed chamber 11.

For example, in smelting step S1 in the present disclosure, after vacuumizing, smelting materials containing the elements: Titanium (Ti), Aluminum (Al), Chromium (Cr), niobium (Nb), Molybdenum (Mo), Manganese (Mn), Nickel (Ni), Silicon (Si), ferrum (Fe), and Boron (B) are placed in the induction smelting apparatus 12 for vacuum smelting, so that the smelting materials are melted and mixed to the molten titanium-aluminum intermetallic 20 with specific ratios of the smelting materials. For example, a vacuum degree is $10^{-4}$ to $10^{-2}$ torr, and the protective gas 0.3 MPa to 0.7 MPa (such as argon or helium). The smelting materials containing the elements: Ti, Al, Cr, Nb, Mo, Mn, Ni, Si, Fe, and B include an aluminum-niobium alloy, titanium diboride, and pure elements of Cr, Mo, Mn, Ni, Si, and Fe. The smelting step S1 is kept in a smelting temperature range of 1550° C. to 1650° C. for 5 minutes to 10 minutes.

Moreover, in the casting and curing step S2 of the present disclosure, the molten titanium-aluminum intermetallic 20 (the casting temperature is about 1550° C. to 1650° C.) is cast. For example, the molten titanium-aluminum intermetallic 20 is cast in the water-cooled mold 13, and can be cured to a titanium-aluminum intermetallic 20' after cooling. Therefore, the titanium-aluminum intermetallic 20 after curing includes the following elements in atomic percentage: Al: 40 at % to 50 at %, Cr: 1 at % to 8 at %, Nb: 1 at % to 8 at %, Mo: 1 at % to 5 at %, Mn: 1 at % to 6 at %, Ni+Si+Fe: 1 at % to 15 at %, B: 0.05 at % to 0.8 at %, and the balance of Ti and inevitable impurities. In detail, after the foregoing smelting materials are placed in the induction smelting apparatus 12 to form a molten alloy, the molten alloy is sampled to measure atomic composition ratios in the molten alloy in the induction smelting apparatus 12, to determine that atomic composition percentages of the molten titanium-aluminum intermetallic 20 after melting and mixing are kept at: Al: 40 at % to 50 at %, Cr: 1 at % to 8 at %, Nb: 1 at % to 8 at %, Mo: 1 at % to 5 at %, Mn: 1 at % to 6 at %, Ni+Si+Fe: 1 at % to 15 at %, B: 0.05 at % to 0.8 at %, and the balance of Ti and inevitable impurities. Under the condition of Ni+Si+Fe: 1 at % to 15 at %, Ni≤8 at %, Si≤8 at %, and Fe≤8 at %.

The addition of Chromium (Cr), ferrum (Fe), Manganese (Mn), and Nickel (Ni) can decrease an alloy liquidus temperature of the titanium-aluminum intermetallic, increase a superheat degree of the molten titanium-aluminum intermetallic, decrease a solidification time, significantly increase a solidus-liquidus interval, and increase alloy fluidity at the same time. Silicon (Si) can increase oxidation resistance of an alloy, and decrease formation of an oxide film on the surface of a high-temperature molten titanium-aluminum intermetallic, so as to reduce surface tension of the molten titanium-aluminum intermetallic and increase alloy fluidity. Moreover, Silicon (Si) can also decrease a degree of reaction between the molten titanium-aluminum intermetallic and a shell of the mold, and increase a flow speed of the molten titanium-aluminum intermetallic at boundaries. Boron (B) has an effect of grain refinement and is conducive to increasing fluidity. Because fine grains hinder the growth of coarse dendrites, a critical solid fraction is increased, thereby increasing the flow time and the filling length.

Figure 3A:
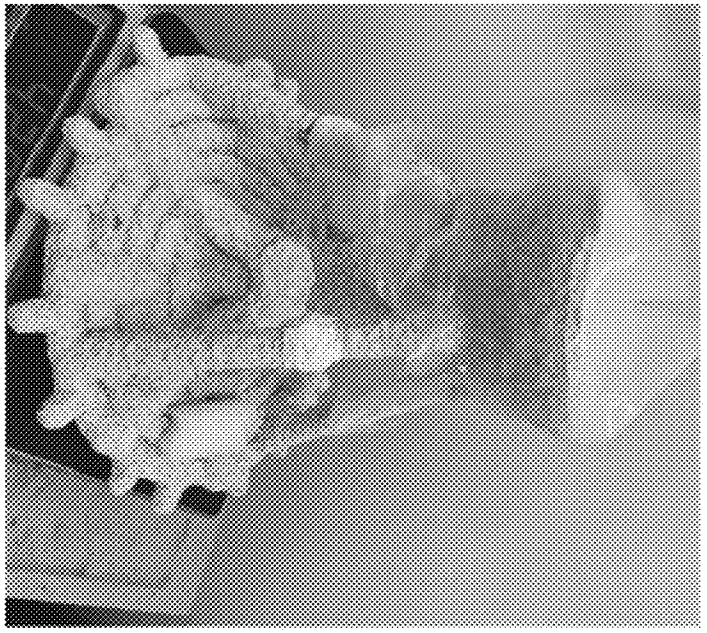
FIG. 3*a* is a three-dimensional diagram of a mold used for a casting fluidity test according to the present disclosure.
Figure 3B:
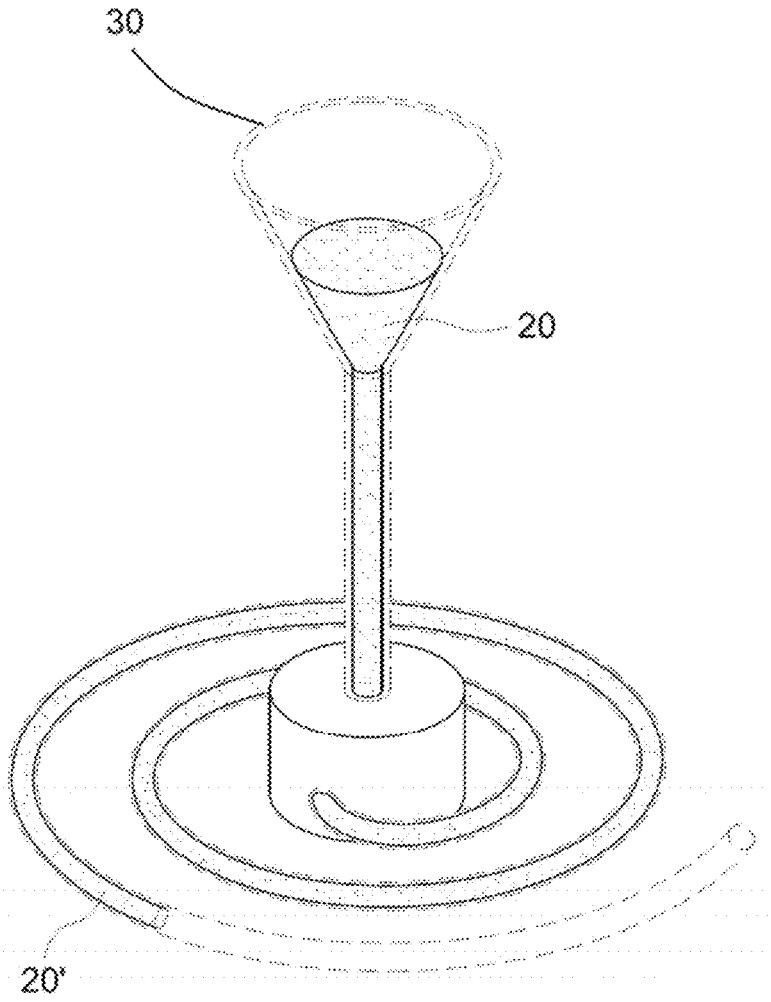
FIG. 3*b* is a schematic diagram showing operations of a casting fluidity test according to the present disclosure.
Figure 4:
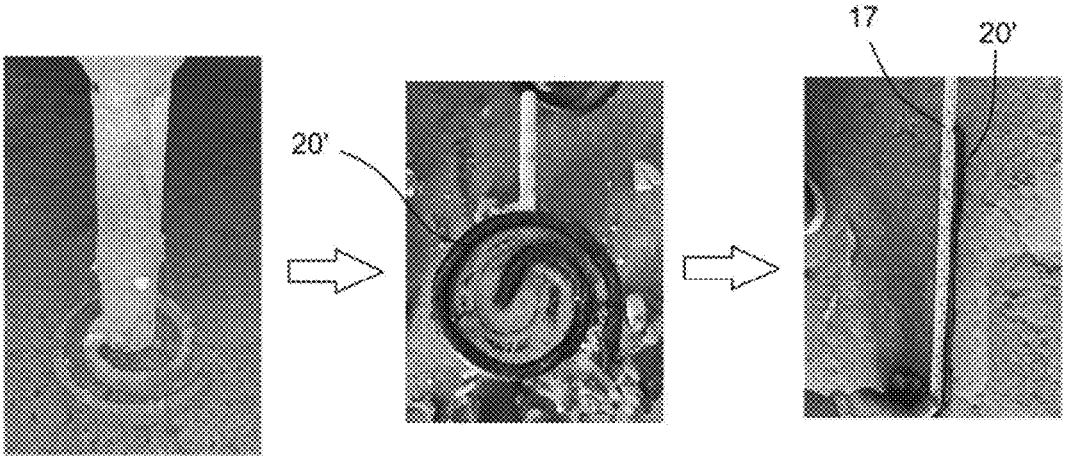
FIG. 4 is a diagram showing morphology of a molten titanium-aluminum intermetallic after casting according to the present disclosure, showing a spiral length of a titanium-aluminum intermetallic is measured.

Casting fluidity of the titanium-aluminum intermetallic is extremely complex, and thus in the casting and curing step S2 of the present disclosure, an experimental method needs to be designed to collect valid data. FIG. 3*a* shows a mold used for a casting fluidity test. FIG. 3*b* is a schematic diagram showing operations of a casting fluidity test. In this embodiment, the mold 30 is a ceramic mold, the molten titanium-aluminum intermetallic 20 is cast in the mold 30, and the mold 30 includes a spiral channel. The titanium-aluminum intermetallic 20' in the spiral channel after casting is used for the casting fluidity test, and the size of the spiral channel is designed as length×width (8 mm×8 mm). A degree of the casting fluidity can be determined by a spiral length of the titanium-aluminum intermetallic 20' in the spiral channel, an improvement effect of the casting fluidity can be obtained, and the titanium-aluminum intermetallic 20' is compared with a commercial titanium-aluminum intermetallic material (TiAl4822). FIG. 4 is a diagram showing morphology of a titanium-aluminum intermetallic 20' after casting. The spiral length of the titanium-aluminum intermetallic 20' in the spiral channel after casting is measured by using a ruler 17 to quantify the degree of the casting fluidity. The differences in the composition ratio and the spiral length of the titanium-aluminum intermetallic between Embodiments 1 to 4 of the present disclosure and Comparative Embodiment 11 are shown in Table 1 below:

TABLE 1

| | Al | Cr | Nb | Mn | Mo | B |
|---|---|---|---|---|---|---|
| Embodiment 1 | 47.908 | 2.521 | 1.134 | 3.081 | 1.055 | 0.256 |
| Embodiment 2 | 48.205 | 2.211 | 1.406 | 2.213 | 1.115 | 0.511 |
| Embodiment 3 | 46.955 | 3.220 | 2.562 | 2.001 | 1.963 | 0.353 |
| Embodiment 4 | 47.221 | 1.688 | 2.253 | 1.211 | 1.022 | 0.229 |
| Comparative Embodiment 11 | 47.622 | 1.875 | 2.002 | 0 | 0 | 0 |

| | Fe + Ni + Si | Spiral length (cm) |
|---|---|---|
| Embodiment 1 | 2.521 | 50.3 |
| Embodiment 2 | 6.446 | 73.8 |
| Embodiment 3 | 8.225 | 62.1 |
| Embodiment 4 | 2.852 | 55.5 |
| Comparative Embodiment 11 | 0 | 42.2 |

It can be learned from Table 1 that the spiral length of 73.8 cm of the titanium-aluminum intermetallic in Embodiment 2 is the longest, representing that the titanium-aluminum intermetallic in Embodiment 2 has the highest casting fluidity, that is, the best castability.

In conclusion, the titanium-aluminum intermetallic in the present disclosure includes the following elements in atomic percentage: Al: 40 at % to 50 at %, Cr: 1 at % to 8 at %, Nb: 1 at % to 8 at %, Mo: 1 at % to 5 at %, Mn: 1 at % to 6 at %, Ni+Si+Fe: 1 at % to 15 at %, B: 0.05 at % to 0.8 at %, and the balance of Ti and inevitable impurities, and has more adequate casting fluidity, that is, better castability.

In summary, the foregoing descriptions only describes preferred implementations or embodiments of technical means used in the present disclosure for resolving problems, and are not intended to limit the implementation scope of the present disclosure. That is, equivalent variations and modifications made in accordance with the claims of the present disclosure or according to the scope of the present disclosure all fall within the scope of the present disclosure.

What is claimed is:

1. A method of manufacturing a titanium-aluminum intermetallic for improving casting fluidity comprising the following steps of:

a smelting step: placing a plurality of smelting raw materials of the titanium-aluminum intermetallic in an induction smelting device, and melting the smelting raw materials to a molten titanium-aluminum intermetallic having casting fluidity; and a casting and curing step: casting the molten titanium-aluminum intermetallic to cure to the titanium-aluminum intermetallic, wherein the titanium-aluminum intermetallic comprises the following elements in atomic percentage: Al: 40 at % to 50 at %, Cr: 3.22 at % to 8 at %, Nb: 1 at % to 8 at %, Mo: 1 at % to 5 at %, Mn: 3.081 at % to 6 at %, Ni+Si+Fe: 1 at % to 15 at %, B: 0.05 at % to 0.8 at %, and the balance of Ti and inevitable impurities, wherein Fe=8 at %.

2. The method of manufacturing the titanium-aluminum intermetallic for improving casting fluidity according to claim 1, wherein under the condition of Ni+Si+Fe: 1 at % to 15 at %, and Ni≤8 at %, Si≤8 at %.

3. The method of manufacturing the titanium-aluminum intermetallic for improving casting fluidity according to claim 1, wherein the smelting step is kept in a smelting temperature range of 1550° C. to 1650° C. for 5 minutes to 10 minutes.

4. The method of manufacturing the titanium-aluminum intermetallic for improving casting fluidity according to claim 1, wherein the smelting raw materials containing the elements: Ti, Al, Cr, Nb, Mo, Mn, Ni, Si, Fe, and B, comprise: an aluminum-niobium alloy, titanium diboride, and pure elements of Cr, Mo, Mn, Ni, Si, and Fe.

5. The method of manufacturing the titanium-aluminum intermetallic for improving casting fluidity according to claim 1, wherein a casting temperature of the molten titanium-aluminum intermetallic is 1550° C. to 1650° C.

6. The method of manufacturing the titanium-aluminum intermetallic for improving casting fluidity according to claim 1, wherein the casting and curing step further comprises: providing a casting fluidity test to determine a degree of the casting fluidity by a spiral length of the titanium-aluminum intermetallic in a spiral channel.

7. The method of manufacturing the titanium-aluminum intermetallic for improving casting fluidity according to claim 6, wherein the casting and curing step further comprises: measuring the spiral length to quantify the degree of the casting fluidity.

* * * * *